United States Patent [19]

Herz et al.

[11] 4,367,279

[45] Jan. 4, 1983

[54] SILVER HALIDE COMPLEXING AGENTS OF SULFONES, NITRILES, AND ONIUM SALTS

[75] Inventors: Arthur H. Herz; Daniel S. Daniel, both of Rochester, N.Y.

[73] Assignee: Eastman Kodak Company, Rochester, N.Y.

[21] Appl. No.: 503,889

[22] Filed: Sep. 6, 1974

[51] Int. Cl.[3] ..... G03C 5/54; G03C 1/48; G03C 5/38

[52] U.S. Cl. ..... 430/234; 430/251; 430/428; 430/455; 430/456

[58] Field of Search ..... 96/29 R, 61 M, 76 R, 96/66 R, 66 HD, 61 R, 76 C; 430/234, 251, 428, 455, 456, 458, 459, 460

[56] References Cited

U.S. PATENT DOCUMENTS 3,615,438 10/1971 Land et al. ..... 96/29 R 3,625,699 12/1971 Stewart et al. ..... 96/107

3,687,662 8/1972 Willems et al. ..... 96/29 R 3,740,221 6/1973 Willems et al. ..... 96/29 R

*Primary Examiner*—Richard L. Schilling

*Attorney, Agent, or Firm*—Henry E. Byers

[57] ABSTRACT

Certain organic, carbon acid silver halide complexing agents in a photographic diffusion transfer system provide suitable replacement for conventional silver halide complexing agents. Such organic, silver halide complexing agents include certain sulfones, nitriles and onium salts. These are especially useful in a silver salt diffusion transfer system. They can be employed with silver halide developing agents, such as in a monobath, and are especially suitable with a hydroxylamine silver halide developing agent. Other addenda commonly employed in photographic diffusion transfer systems can be employed in combination with these silver halide complexing agents.

8 Claims, No Drawings

SILVER HALIDE COMPLEXING AGENTS OF SULFONES, NITRILES, AND ONIUM SALTS

BACKGROUND OF THE INVENTION

1. Field of the Invention

This invention relates to certain organic, silver halide complexing agents and photographic elements, compositions and processes for diffusion transfer systems. In one of its aspects the invention relates to a photographic product for a diffusion transfer system which employs certain organic, silver halide complexing agents. Another aspect of the invention relates to a photographic processing composition comprising a silver halide developing agent with such organic, silver halide complexing agents. A further aspect relates to a photographic process for a diffusion transfer system employing the described silver halide complexing agents.

2. Description of the State of the Art

Photographic diffusion transfer processes, compositions and elements have become well known in recent years. A diffusion transfer system is characterized by the use of a photographic element, typically containing a photographic silver salt, and an image receiver or precipitating layer contiguous to the photographic silver salt. After exposure of the photographic element, typically a processing composition, such as one containing a silver halide developing agent and a silver halide complexing agent, is applied between the exposed photographic element and the image receiver or precipitating layer. The processing composition, in practice, has contained a silver halide solvent, such as sodium thiosulfate, which causes the unexposed silver salt, usually silver halide, to dissolve, forming a silver complex which diffuses to the image receiver or precipitating layer where development nuclei or an image precipitating agent in that layer causes the silver to be reduced or precipitated from the silver complex imagewise. Development nuclei or precipitating agents can be present in the image receiver before contact with the complex silver or the nuclei can be formed in situ. Typical diffusion transfer systems, elements, compositions and processes are described, for example, in U.S. Pat. No. 2,698,237 of Land issued Dec. 28, 1954; U.S. Pat. No. 2,647,056 of Land issued July 28, 1953; and U.S. Pat. No. 3,345,166 of Land issued Oct. 3, 1967.

A processing composition employed in a typical diffusion transfer system normally contains a silver halide developing agent and a silver halide complexing agent. Processing is usually carried out by applying a viscous fluid layer between the photographic element and an image receiving layer as described.

The requirements for silver halide developing agents and silver halide complexing agents for diffusion transfer systems are very stringent and relatively few such agents which are satisfactory for general silver halide developing processes are satisfactory or sufficiently active for diffusion transfer systems without providing undesired sensitometric properties. Attempts have been made to provide a replacement for thiosulfate silver halide complexing agents which provides the desired silver complex and image transfer. Thiosulfate silver halide complexing agent replacements are described, for example, in U.S. Pat. No. 2,857,274 of Land et al. issued Oct. 21, 1958; U.S. Pat. No. 2,857,275 of Land et al. issued Oct. 21, 1958 and U.S. Pat. No. 2,857,276 of Land et al. issued Oct. 21, 1958. Uracil is a typical compound which has been employed in combination with, for example, a nitrogenous base to replace a thiosulfate silver halide complexing agent in a diffusion transfer system.

There has accordingly been a counting need to provide organic, silver halide complexing agents for diffusion transfer systems, elements, compositions and diffusion transfer processes which provide desired maximum density. There has also been a continuing need to provide an organic, silver halide complexing agent which provides desired silver halide complexing activity in processing composition which hydroxylamine silver halide developing agents. There has been a further need to provide a suitable organic, silver halide complexing agent which is a replacement for thiosulfate silver halide complexing agents and which provides a desired image in a diffusion transfer system.

SUMMARY OF THE INVENTION

According to the invention, certain organic, carbon acid silver halide complexing agents, as described herein, in a photographic diffusion transfer product, composition and/or process provide suitable silver halide complexing agents and provide desired maximum density without undesired increase in minimum density.

An organic, carbon acid which is a sulfone when used in a photographic diffusion transfer product, composition and/or process provides an especially suitable organic silver halide complexing agent.

DETAILED DESCRIPTION OF THE INVENTION

A range of organic, carbon acid silver halide complexing agents, as described herein, can be employed according to the invention. A carbon acid silver halide complexing agent includes compounds of the formula:

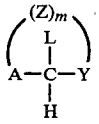

wherein

CH is a carbon acid moiety with a pKa greater than about 8 and smaller than about 16; pKa, as employed herein, can be determined by employing procedures which are known in the art, such as described in Moeller, "Quantitative Analysis", McGraw Hill Book Co., 1958, page 81 and following:

L is hydrogen or alkyl containing 1 to 7 carbon atoms or aryl of 4 to 12 carbon atoms and can be exemplified by methyl, ethyl, hydroxyethyl, carboxyethyl, sulfopropyl, p-tolyl, etc.

m is 0 or an integer of 1 through 4.

When m is not zero but an integer 1, 2, 3, or 4, Z (taken with A, $LC^H$ and Y) complexes a cyclic structure containing 4, 5, 6, 7 ring atoms; then A and Y can be independently selected from the following groups:

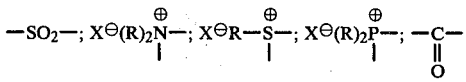

in which R is alkyl containing 1 to 7 carbon atoms where $X^{\ominus}$ is an anion such as perchlorate, halide, paratoluene sulfonate, sulfate, chlorate, tetrafluoroborate, etc. When m is zero, the carbon acid group is not part of a cyclic structure and the formula reduces to

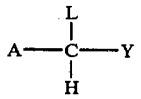

where A and Y are:

| A | Y |
|---|---|
| $RSO_2$— | —$NO_2$ |
| NC— | —CN |
| $F_3C$— | —$CF_3$ |
| $X^{\ominus}(R)_3P^{\oplus}$— or $X^{\ominus}(R)_2S^{\oplus}$— or | —$N(R)_3X^{\ominus}$ or —$S^{\oplus}(R)_2X^{\ominus}$ or |
| $\ominus\ominus(R)_3N$— | —$\overset{\oplus}{P}(R)_3X^{\ominus}$ |
| $R^1C$—‖O | —$CR^1$‖O |

where $R^1$ is R, OR, $NH_2$ or $NR_2$. R is alkyl containing 1 to 7 carbon atoms.

Various organic, silver halide complexing agents which are ketones, esters, amides, nitriles, sulfones, nitrites, fluorocarbons, ammonium, sulfonium and/or phosphonium salts can be employed according to the invention. These are indicated in the following examples:

Fluorocarbons which are useful include:

$H_3CSO_2$—$CH_2$—$CF_3$—methyl-2,2,2-trifluoroethyl sulfone $O_2N$—$CH_2$—$CF_3$—1,1,1-trifluoro-2-nitroethane $F_3C$—$CH_2$-$S^{\oplus}(CH_3)_2ClO_4^{\ominus}$—dimethyl-2,2,2-trifluoroethyl sulfonium perchlorate Nitrile compounds include:

NC—$CH_2$—NC—malononitrile $H_3CSO_2$—$CH_2$—CN—methyl-sulfonyl-acetonitrile

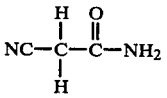

—2-cyano acetamide

Sulfonium compounds include:

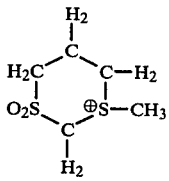

pts.$^{\ominus}$ 1-methyl-3,3-dioxo-1,3-dithionium p-toluenesulfonate

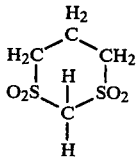

1,3-dithiane-1,1,3,3-tetraoxide

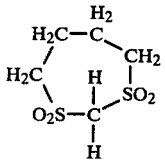

1,3-Dithiacycloheptane-1,1,3,3-tetraoxide $CH_3SO_2CH_2S^{\oplus}(CH_3)_2ClO_4^{\ominus}$—dimethyl(methylsulfonylmethyl) sulfonium perchlorate Phosphonium compounds include:

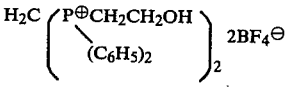

methylenebis[diphenyl(2-hydroxyethyl)Phosphonium tetrafluoroborate]

Other activated methylene compounds include:

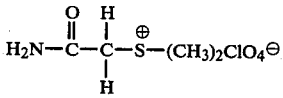

carbamoyl methyl dimethyl sulfonium perchlorate $CH_3SO_2CH_2COCH_3$

Methyl sulfonyl-2-propanone

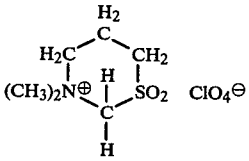

1,1-dimethyl-3,3-dioxotetrahydro-1,3-thiazinium perchlorate

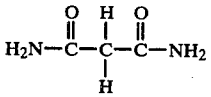

Malonamide

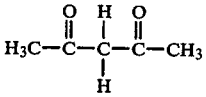

Acetylacetone

The described carbon acid can be prepared by methods known in the chemical art.

The described organic, silver halide complexing agents used in the practice of the invention can be employed in a range of physical locations in a photographic diffusion transfer system. However, the described organic, silver halide complexing agents are typically employed in a viscous processing composition applied between a photographic element and an image receiver.

One or more of the described silver halide complexing agents can be employed in one or more layers of a photographic element and/or in a processing composition and/or in an image receiver layer, if desired. Combinations of the described organic, silver halide complexing agents can be employed. The optimum location of the silver halide complexing agent will depend upon the desired image, processing conditions, particular silver halide complexing agent, particular silver halide developing agent employed and the like. If desired, one or more silver halide developing agents can be employed in the photographic element and/or processing composition and/or image receiver and the described organic, silver halide complexing agent employed in the photographic element and/or processing composition and/or image receiver also. The described silver halide complexing agents are usually employed in a processing composition.

Suitable diffusion transfer systems, processes, processing compositions and elements therefor which can be employed in the practice of the invention are described, for example, in U.S. Pat. No. 2,352,014 of Rott issued June 20, 1944; U.S. Pat. No. 2,452,181 of Land issued Feb. 27, 1951; U.S. Pat. No. 3,337,342 of Green issued Aug. 27, 1967 and Belgian Patent No. 739,706. The organic, silver halide complexing agents can be used in so-called, high speed, diffusion transfer processes and compositions as described, for example, in U.S. Pat. No. 3,326,683 of Land et al issued June 20, 1967 or in other types of diffusion transfer systems, processes and compositions therefor, such as described in U.S. Pat. No. 2,857,274 of Land et al. issued Oct. 21, 1958; U.S. Pat. No. 2,857,275 of Land et al. issued Oct. 21, 1958; and U.S. Pat. No. 2,857,276 of Land et al. issued Oct. 21, 1958 as well as in U.S. Pat. No. 3,020,155 of Yackel et al. issued Feb. 6, 1962; U.S. Pat. No. 2,584,030 of Land issued Jan. 29, 1952 and U.S. Pat. No. 2,023,623 of Land issued Feb. 2, 1960. These references also describe the typical photographic product suitable for diffusion transfer systems comprising in combination (a) a photographic element comprising a photographic silver salt, e.g., a photographic silver halide emulsion layer, (b) a processing composition suitable for a diffusion transfer system, typically in a rupturable container, and (c) an image receiver.

One embodiment of the present invention is: in a photographic silver salt, diffusion transfer product comprising (a) a photographic element comprising photographic silver halide, (b) a processing composition, and (c) an image receiving layer, the said product comprising a silver halide complexing agent, the improvement comprising an organic, silver halide complexing agent which is a carbon acid. Especially suitable organic, silver halide complexing agents in such a photographic product are 1,3-dithiane-1,1,3,3-tetraoxide; 1,3-dithiacycloheptane-1,1,3,3-tetraoxide; 1-methyl-3,3-dioxo-1,3-dithionium perchlorate methyl-2,2,2-trifluoroethyl sulfone.

Hydroxylamine silver halide developing agents and nitrogenous bases are especially useful in combination with the described organic, silver halide complexing agents.

Suitable hydroxylamine silver halide developing agents and nitrogenous bases which can be employed in combination with the described organic, silver halide complexing agents are sent out, for example, in U.S. Pat. No. 2,857,274 of Land et al. issued Oct. 21, 1958; U.S. Pat. No. 2,857,275 of Land et al. issued Oct. 21, 1958 and U.S. Pat. No. 2,857,276 of Land et al. issued Oct. 21, 1958. Examples of hydroxylamine silver halide developing agents are Hydroxylamine
N-methyl hydroxylamine
N-ethyl hydroxylamine
N-propyl hydroxylamine
N-isopropyl hydroxylamine
N,N-diethyl hydroxylamine
N-methyl-N-propyl hydroxylamine
N-methyl-N-isopropyl hydroxylamine
N-ethyl-N-propyl hydroxylamine
N,N-diisopropyl hydroxylamine
N,N-di-n-propyl hydroxylamine
N-ethyl-N-methylbutyl hydroxylamine
N-methyl-N-isobutyl hydroxylamine
N-n-propyl-N-n-butyl hydroxylamine
N-hydroxy-pyrrolidone
N-hydroxy-piperidine
N-hydroxymorpholine
N-benzyl hydroxylamine
N-ethyl-N-hydroxyethyl hydroxylamine
N-benzyl-N-methyl hydroxylamine
N-hydroxyethyl-N-carboxyethyl hydroxylamine
α-Hydroxylamine-β-phenyl propionic acid
N-phenyl hydroxylamine
N-p-carboxyphenyl hydroxylamine
N-p-methoxy phenyl hydroxylamine
N,N'-methylene bis (n-phenyl hydroxylamine)
m-Hydroxylamino-benzene sulfonic acid It is often advantageous to employ a nitrogenous base in combination with the described organic, silver halide complexing agent in addition to or in place of the described hydroxylamine silver halide developing agent. Examples of suitable nitrogenous bases are described in U.S. Pat. No. 2,857,274 of Land et al. issued Oct. 21, 1958; U.S. Pat. No. 2,857,275 of Land et al. issued Oct. 21, 1958 and U.S. Pat. No. 2,857,276 of Land et al. issued Oct. 21, 1958. Examples of suitable nitrogenous bases are:

Ammonia
Sec. amylamine
Ethylamine
n-Butylamine
Allylamine
Diethylamine
Dipropylamine
Trimethylamine
Triethanol amine
Diethylene triamine
Triethylene tetramine
N-hydroxyethyl propylene diamine
Trimethylene diamine
Ethylene diamine
Aminoethyl ethanol amine
Hydroxyethyl diethylene triamine
Tetraethylene pentamine
Guanidine hydrochloride
Piperidine
Pyrrolidone
2,5-dimethyl piperazine
Polyethylene imine
p-Aminophenol
2,4-diaminophenol dihydrochloride
Meta-amino-benzoic acid
Hydrazine
Methyl hydrazine
Symmetrical dimethyl hydrazine Unsymmetrical dimethyl hydrazine The described organic, silver halide complexing agents can be employed in a photographic element, composition and/or process in a range of concentrations depending upon the particular organic, silver halide complexing agent, processing conditions, silver halide developing agents employed, development nuclei employed and the like.

A range of concentration of the described organic, silver halide complexing agents can be employed in the practice of the invention. A typical range of concentration when the described organic, silver halide complexing agents are employed in a processing composition is about 3 to about 200 grams, usually about 25 to about 200 grams, of silver halide complexing agent per liter of processing composition. In a photographic element a range of about 0.25 to about 4 moles of silver halide complexing agent can be employed per mole of photographic silver halide to be complexed. This range also applies when the described silver halide complexing agent is to be employed in an image receiver.

It is generally desirable to use pure materials and products according to the practice of the invention.

The silver halide emulsions employed with this invention can comprise silver chloride, silver bromide, silver bromoiodide, silver chlorobromoiodide or mixtures thereof. The emulsions can be coarse or fine grain and can be prepared by any of the well-known procedures employed in emulsion making such as single-jet emulsions, double-jet emulsions such as Lippmann emulsions, ammoniacal emulsions, thiocyanate or thioether ripened emulsions, such as those described in U.S. Pat. No. 2,222,264 of Nietz et al. issued Nov. 19, 1940; U.S. Pat. No. 3,320,069 of Illingsworth issued May 16, 1967; and U.S. Pat. No. 3,271,157 of McBride issued Sept. 6, 1966. Surface image emulsions can be used or internal image emulsions such as those described in U.S. Pat. No. 2,592,250 of Davey et al. issued Apr. 8, 1952; U.S. Pat. No. 3,206,313 of Porter et al. issued Sept. 14, 1965; U.S. Pat. No. 3,367,778 of Berriman et al. issued Feb. 6, 1968; and U.S. Pat. No. 3,447,927 of Bacon et al. issued June 3, 1969. Negative type emulsions can be used or direct positive emulsions, such as those described in U.S. Pat. No. 2,184,013 of Leermakers issued Dec. 19, 1939; U.S. Pat. No. 2,541,472 of Kendall et al. issued Feb. 13, 1951; British Pat. No. 723,019 of Schouweneaars; French Pat. No. 1,520,785 published Mar. 4, 1968 and U.S. Pat. No. 2,861,885 of Land issued Dec. 8, 1953.

The emulsions used with this invention can be sensitized with chemical sensitizers such as with reducing agents; sulfur, selenium or tellurium compounds; gold, platinum or palladium compounds; or combination of these. Suitable procedures for chemical sensitization are described in U.S. Pat. No. 1,623,499 of Sheppard issued Apr. 5, 1967; U.S. Pat. No. 2,399,083 of Waller et al. issued Apr. 23, 1946; U.S. Pat. No. 3,297,447 of McVeigh issued Jan. 10, 1967; and U.S. Pat. No. 3,297,446 of Dunn issued Jan. 10, 1967.

The silver halide emulsions, processing compositions and/or image receivers used in the practice of the invention can contain speed increasing compounds such as polyalkylene glycols, cationic surface active agents and thioethers or combinations of these as described in U.S. Pat. No. 2,886,437 of Piper issued May 12, 1959; U.S. Pat. No. 3,046,134 of Dann et al. issued July 24, 1962; U.S. Pat. No. 2,944,900 of Carroll et al. issued July 12, 1960; and U.S. Pat. No. 3,294,540 of Goffe issued Dec. 27, 1966.

The silver halide emulsions and image receivers used in the practice of the invention can be protected against the production of fog and can be stabilized against loss of sensitivity during keeping. Suitable antifoggants and stabilizers each used alone or in combination include thiazolium salts described in U.S. Pat. No. 2,131,038 of Brooker et al. issued Sept. 27, 1938 and U.S. Pat. No. 2,694,716 of Allen issued Nov. 16, 1964; the azaindenes described in U.S. Pat. No. 2,886,437 of Piper issued May 12, 1959 and U.S. Pat. No. 2,444,605 of Heimbach issued July 6, 1948; the mercury salts as described in U.S. Pat. No. 2,728,663 of Allen et al. issued Dec. 27, 1955; the urazoles described in U.S. Pat. No. 3,287,135 of Anderson issued Nov. 22, 1966; the sulfocatechols described in U.S. Pat. No. 3,236,652 of Kennard et al. issued Feb. 22, 1966; the oximes described in British Pat. No. 623,448 published May 19, 1949; nitron; nitroindazoles; the mercaptotetrazoles described in U.S. Pat. No. 2,403,927 of Kendall et al. issued July 16, 1946; U.S. Pat. No. 3,266,897 of Kennard et al. issued Aug. 16, 1966 and U.S. Pat. No. 3,397,987 of Luckey et al. issued Aug. 20, 1968; the polyvalent metal salts described in U.S. Pat. No. 2,839,405 of Jones issued June 17, 1958; the thiuronium salts described in U.S. Pat. No. 3,220,839 of Hertz issued Nov. 30, 1965; the palladium, platinum and gold salts described in U.S. Pat. No. 2,566,263 of Trivelli et al. issued Aug. 28, 1951 and U.S. Pat. No. 2,597,915 of Yutzy et al. issued May 27, 1952.

The photographic and other hardenable layers employed in a photographic element or image receiver in the process of this invention can be hardened by various organic or inorganic hardeners, alone or in combination, such as the aldehydes and blocked aldehydes, ketones, carboxylic and carbonic acid derivatives, sulfonate esters, sulfonyl halides and vinyl sulfones, active halogen compounds, epoxy compounds, azaindenes, active olefins, isocyanates, carbodiimides, mixed-function hardeners and polymeric hardeners such as oxidized polysaccharides like dialdehyde starch, oxyguargum and the like.

The photographic emulsions and elements including image receivers described, employed in the practice of this invention, can contain various colloids alone or in combination as vehicles, binding agents and various layers. Suitable hydrophilic materials include both naturally-occurring substances such as proteins, for example, gelatin, gelatin derivatives, cellulose derivatives, polysaccharides such as dextran, gum arabic and the like; and synthetic polymeric substances such as water-soluble polyvinyl compounds like poly(vinylpyrrolidone), acrylamide polymers and the like.

The described photographic emulsion layers, image receivers and other layers of a photographic element employed in the practice of this invention can also contain, alone or in combination with hydrophilic, water-permeable colloids, other synthetic polymeric compounds such as dispersed vinyl compounds, such as in latex form and particularly those which increase the dimensional stability of the photographic materials. Suitable synthetic polymers include those described, for example, in U.S. Pat. No. 3,142,568 of Nottorf issued July 28, 1964; U.S. Pat. No. 3,193,386 of White issued July 6, 1965; U.S. Pat. No. 3,062,674 of Houck et al. issued Nov. 6, 1962; U.S. Pat. No. 3,220,844 of Houck et al. issued Nov. 30, 1965; U.S. Pat. No. 3,287,289 of Ream et al. issued Nov. 22, 1966; and U.S. Pat. No.

3,411,911 of Dykstra issued Nov. 19, 1968. Particularly effective are those water insoluble polymers of alkyl acrylate and methacrylate, acrylic acid, sulfoalkylacrylates or methacrylates, those which have cross-linking sites which facilitate hardening or curing and those having recurring sulfobetaine units as described in Canadian Pat. No. 774,054.

The photographic elements and image receivers used in the practice of the invention can contain antistatic or conducting layers. Such layers can comprise soluble salts such as chlorides, nitrates and the like, evaporated metal layers, ionic polymers such as those described in U.S. Pat. No. 2,861,056 of Minsk issued Nov. 18, 1958 and U.S. Pat. No. 3,206,312 of Sterman et al. issued Oct. 14, 1965 or insoluble inorganic salts such as those described in U.S. Pat. No. 3,428,451 of Trevoy issued Feb. 18, 1969.

The photographic elements, and/or image receivers and other layers of a photographic element employed and described herein can be coated on a wide variety of supports. Typical supports include cellulose nitrate film, cellulose ester film, poly(vinyl acetal) film, polystyrene film, poly(ethylene terephthalate) film, polycarbonate film, and related films or resinous materials, as well as glass, paper, metal and the like. Typically a flexible support is employed, especially a paper support, which can be partially acetylated or coated with baryta and/or an alpha olefin polymer, particularly a polymer of an alpha olefin containing 2 to 10 carbon atoms such as polyethylene, polypropylene, ethylene-butene copolymers and the like.

The photographic layers and/or image receiver layers employed in the practice of this invention can contain plasticizers and lubricants such as polyalcohols, e.g., glycerin and diols of the type described in U.S. Pat. No. 2,960,404 of Milton issued Nov. 15, 1968; fatty acids or esters such as those described in U.S. Pat. No. 2,588,765 of Robijns issued Mar. 11, 1952 and U.S. Pat. No. 3,121,060 of Duane issued Feb. 11, 1964 and silicone resins such as those described in British Pat. No. 955,061.

The photographic layers, processing compositions and/or image receivers employed in the practice of this invention can contain surfactants such as saponin, anionic compounds such as alkyl or aryl sulfonates described in U.S. Pat. No. 2,600,831 of Baldsiefen issued June 17, 1952 and amphoteric compounds such as those described in U.S. Pat. No. 3,133,816 of Ben-Ezra issued May 19, 1964.

The photographic elements and/or image receivers used in the practice of the invention can contain brightening agents including stilbene, triazine, oxazole, and coumarin brightening agents. Water-soluble brightening agents can be used such as those described in German Pat. No. 972,067 and U.S. Pat. No. 2,933,390 of McFall et al. issued Apr. 19, 1960 or dispersions of brighteners can be used, such as those described in German Pat. No. 1,150,274 and U.S. Pat. No. 3,406,070 of Oetiker et al. issued Oct. 15, 1968 and French Pat. No. 1,530,244.

The light-sensitive silver halide emulsions employed in the practice of the invention can be X-ray or other non-spectrally sensitized emulsions. They also can contain spectral sensitizing dyes and be conveniently orthosensitized or pansensitized with such dyes. For instance, these emulsions can be spectrally sensitized by treating with a solution of a sensitizing dye in an organic solvent or the dye can be added in the form of a dispersion as described in British Pat. No. 1,154,781 of Owens at al. For optimum results, the dye may either be added to the emulsion as a final step or at some earlier stage. Sensitizing dyes useful in sensitizing such emulsions are described, for example, in U.S. Pat. No. 2,526,632 of Brooker et al. issued Oct. 24, 1950; U.S. Pat. No. 2,503,776 of Sprague issued Apr. 11, 1950; U.S. Pat. No. 2,493,748 of Brooker et al. issued Jan. 10, 1950 and U.S. Pat. No. 3,384,486 of Taber et al. issued May 21, 1968. Spectral sensitizers which can be used include the cyanines, merocyanines, complex (trinuclear or tetranuclear) merocyanines, complex (trinuclear or tetranuclear) cyanines, homopolar cyanines, styryls, and hemicyanaines, e.g. enamine hemicyanines, oxonols and hemioxonols. The cyanines can contain such basic nuclei as thiazolines, pyrrolines, pyridines, oxazoles, thiazoles, selenazoles and oxazolines, selenazoles, and imidazoles. Such nuclei can contain sulfoalkyl; carboxylalkyl and alkylamino groups and can be fused to benzene or naphthalene rings either unsubstituted or substituted with halogen, phenyl, alkyl or alkoxy groups. The dyes can be symmetrical or unsymmetrical and can contain alkyl, phenyl or heterocyclic substituents on the polymethine chain. The merocyanine dyes can contain the basic nuclei mentioned as well as acid nuclei such as thiohydantoins, rhodanines, oxazolidenediones, barbituric acids, thiazolineones and malononitrile.

These acid nuclei can be substituted with alkyl, alkylene, phenyl, carboxylakyl, sulfoalkyl, hydroxyalkyl, alkoxyalkyl, alkylamino groups or heterocyclic nuclei.

Combinations of these dyes can be used, if desired. In addition, supersensitizing addenda which do not absorb visible light can be included, for instance, ascorbic acid derivatives, azaindenes, cadmium salts, and organic sulfonic acids as described in U.S. Pat. No. 2,933,390 of McFall et al. and U.S. Pat. No. 2,937,089 of Jones et al. issued May 17, 1960.

The various addenda including sensitizing dyes employed in the practice of this invention can be added to the photographic emulsions and/or other layers of a photographic element and/or image receiver from water solutions or suitable organic solvent solutions. The compounds can be added using various procedures including those described in U.S. Pat. No. 2,912,343 of Collins et al. issued Nov. 10, 1959; U.S. Pat. No. 3,342,605 of McCrossen et al. issued Sept. 19, 1967; U.S. Pat. No. 2,996,287 of Audran issued Aug. 15, 1961 and U.S. Pat. No. 3,425,835 of Johnson et al. issued Feb. 4, 1969.

The layers of a photographic element and/or image receiver used in the practice of the invention can be coated by various coating procedures including dip coating, airknife coating, curtain coating, or extrusion coating using hoppers of the type described in U.S. Pat. No. 2,681,294 of Beguin issued June 15, 1954. If desired, two or more layers can be coated simultaneously by the procedures described in U.S. Pat. No. 2,761,791 of Russell issued Sept. 4, 1956 and British Pat. No. 837,095.

The described organic, silver halide complexing agents employed in the practice of the invention can be used in colloid transfer processes. They can also be used in photographic elements and/or processing compositions intended for use in monobath processing such as described in U.S. Pat. No. 2,875,048 of Haist et al. issued Feb. 24, 1959 and British Pat. No. 1,063,844 of Beavers et al. published Mar. 30, 1967.

The described organic, silver halide complexing agents employed in the practice of the invention can also be used in multilayer, single element diffusion transfer systems which utilize undeveloped silver halide in non-image areas of a negative to form a positive by physical development of this silver onto a nuclei containing contiguous, image receiving layer after which the upper layer is removed by scrubbing, washing, stripping or other suitable method. Processes of this type are described, for instance, in U.S. Pat. No. 3,020,155 of Yackel et al. issued Feb. 6, 1962. An image can be obtained in elements of this type when they are processed by use of a so-called external processing web containing silver halide developing agents, usually in combination with another silver halide solvent and other processing or coating components dispersed in a vehicle and coated on a suitable support. Processing webs of this type are described, for example, in U.S. Pat. No. 3,179,517 of Tregillus et al. issued Apr. 20, 1965.

The described organic, silver halide complexing agents employed in the practice of the invention can be employed in an element containing development nuclei or silver precipitating nuclei, such an an image receiver. As described, they can also be employed in photographic elements and/or processing compositions designed for use with an image receiver.

Development nuclei or silver precipitating agents which can be employed in diffusion transfer systems, as described, can be physical development nuclei or chemical precipitants including, for example: (a) heavy metals in colloidal form and salts of these metals, (b) salts of amines which form silver salts and/or (c) non-diffusing polymeric materials with functional groups capable of combining with silver amines.

Suitable development nuclei and/or silver image precipitating agents within the described classes include metal sulfides, selenides, polysulfides, polyselenides, thiourea and its derivatives, stannous halides, sulfur, gold, platinum, palladium, and mercury, colloidal sulfur, amino-guanidine sulfate, aminoguanidine carbonate, arsenous oxide, sodium stannite, hydrazines, xanthates, and similar agents disclosed, for example, in U.S. Pat. No. 3,020,155 of Yackel et al. issued Feb. 6, 1962. A non-diffusing polymeric silver precipitant or development nuclei, such as poly(vinyl mercaptoacetate) can also be employed.

A wide range of concentrations of development nuclei or silver precipitating agents can be employed. A concentration of the development nuclei or silver precipitate in the image receiving layer must be at least sufficient to insure the development of a positive image and sufficient removal of undeveloped silver salt from the light-sensitive layer to be processed. Usually the concentration of the developing agents, as described, is about 320 milligrams per square foot of the layer containing the precipitants or development nuclei.

The described organic, silver halide complexing agents employed in the practice of the invention can be employed in combination with silver halide developing agents. Suitable silver halide developing agents which can be employed in combination with the described developing agents include, for example, polyhydroxybenzenes such as hydroquinone developing agents, e.g. hydroquinone, tertiary butyl hydroquinone, 2,5-dimethyl hydroquinone or 2,6-dimethyl hydroquinone; catechol and pyrogallol; chloro-substituted hydroquinones such as chlorohydroquinone or dichlorohydroquinone; alkoxy substituted hydroquinones such as methoxyhydroquinone or ethoxyhydroquinone; aminophenol developing agents such as 2,4-diaminophenols and methylaminophenols; ascorbic acid developing agents such as ascorbic acid, ascorbic acid ketals, and ascorbic acid derivatives such as those described in U.S. Pat. No. 3,337,342 of Green issued Aug. 22, 1967; hydroxylamine developing agents, as described; 3-pyrazolidone developing agents such as 1-phenyl-3-pyrazolidone and 1-phenyl-4-methyl-4-hydroxymethyl-3-pyrazolidone, including those described in British Pat. No. 930,572 published July 3, 1963; hydroxytetronic acids and imides; reductone developing agents such as anhydro dihydro piperidino hexose reductone; and aminomethyl hydroquinone developing agents such as morpholino methyl hydroquinone. Such developing agents can be used alone or in combination. It is usually desirable to use other developing agents than aminophenol compounds because of the tendency of these compounds to cause undesired stain.

Another embodiment of the invention is: in a photographic processing composition comprising a hydroxylamine photographic silver halide developing agent with a silver halide complexing agent, the improvement comprising about 25 to about 200 grams per liter of said processing composition of an organic carbon acid as said silver halide complexing agent. This composition is typically an aqueous alkaline solution.

Especially suitable organic silver halide complexing agents in the described processing composition are 1,3-dithiane-1,1,3,3-tetraoxide; 1,3-dithia-cycloheptane-1,1,3,3-tetraoxide; 1-methyl-3,3-dioxo-1,3-dithionium perchlorate and methyl-2,2,2-trifluoroethyl sulfone.

The described processing compositions can contain other silver halide developing agents than hydroxylamines. However, hydroxylamines provide especially suitable results. For example, the described organic, silver halide complexing agents of the invention can be employed in a photographic processing composition containing a hydroxylaimine silver halide developing agent with 2,6-dimethylhydroquinone and/or 2,5-dimethylhydroquinone and/or an amino reductone silver halide developing agent.

The processing composition, as described, is typically employed in a combination of (a) a photographic element comprising a photographic silver salt, (b) a viscous processing composition comprising an organic, silver halide complexing agent as described, an alkaline development activator, and a silver halide developing agent which is typically a hydroxylamine silver halide developing agent with (c) an image receiving layer comprising development nuclei, especially palladium development nuclei, dispersed in a polymeric binder.

A processing composition employed in the practice of the invention is typically a viscous processing composition. A wide range of viscosity can be employed. The viscosity can be about 20 to about 100,000 centipoises, typically about 100 to about 10,000 centipoise. Various thickening agents are suitable in the described processing compositions and processes of the invention. Any of those commonly employed in diffusion transfer photographic systems can be employed, as well as those employed in viscous monobaths. Typical thickening agents are described in U.S. Pat. No. 3,120,795 of Land et al. issued Feb. 11, 1964; such as hydroxyethylcellulose and carboxymethylcellulose.

A typical viscous photographic developer which is useful in the practice of the invention comprises an aqueous alkaline liquid containing (a) a silver halide developing agent, (b) a silver halide complexing agent, as described and (c) a thickening agent.

The described organic, silver halide complexing agents can be employed in viscous monobaths. Suitable viscous monobaths in which the described organic, silver halide complexing agents can be employed are set out, for example, in the "Monobath Manual" by Grant M. Haist (1966) and U.S. Pat. No. 3,392,019 of Barnes et al. issued July 9, 1968.

The described organic, silver halide complexing agents can be employed in a photographic element comprising a support, photographic silver halide and a hydroxylamine silver halide developing agent. The described photographic element can contain other silver halide developing agents, if desired, such as aminomethyl hydroquinones and other silver halide developing agents, as described, which do not adversely effect the sensitometric properties of the element. For example, the described organic silver halide complexing agent can be employed in a photographic emulsion comprising photographic silver halide, a hydroxylamine silver halide developing agent and the described organic silver halide complexing agents.

The described organic, silver halide complexing agents are especially suitable for replacement of the conventional thiosulfate silver halide complexing agent in a diffusion transfer process. Accordingly, another embodiment of the invention is: in a photographic diffusion transfer process comprising developing a latent image in a photographic silver salt layer, contacting undeveloped silver salts in the photographic silver salt layer with a silver halide complexing agent to form an imagewise distribution of a silver complex in the unexposed areas of the photographic silver salt layer; transferring at least part of the silver complex to an image receiver; and reducing the silver complex in the presence of development nuclei to form a visible image on the receiver layer; the improvement comprising employing as the silver halide complexing agent an organic carbon acid as described. The photographic process is typically a black-and-white silver salt diffusion transfer process.

The process is carried out at a pH which activates the described silver halide developing agent. The activating pH is usually about 10 to about 14 with good results being obtained when the pH is above about 12. When the pH of the system is lowered to less than about 8, such as between about 8 and about 2, usually developing activity stops. The optimum pH for any particular diffusion transfer system would be influenced by the particular photographic element, the desired image, various addenda employed in the system, the particular receiver, processing conditions, the particular organic, silver halide complexing agent and the like.

Any development activator can be employed with the described silver halide developing agent and silver halide complexing agents which provides the desired pH and developed image. Typical development activators which can be employed are alkali metal hydroxides, such as sodium hydroxide, potassium hydroxide or lithium hydroxide, as well as organic development activators such as amines, as described, for example, in U.S. Pat. No. 2,857,274 of Land et al. issued Oct. 21, 1958, such as Sec. amylamine
Ethylamine
n-Butylamine
Allylamine
Diethylamine
Dipropylamine
Trimethylamine
Triethanolamine
Diethylene triamine
Triethylene tetramine
N-hydroxyethyl propylene diamine
Trimethylene diamine
Ethylene diamine
Aminoethyl ethanol amine
Hydroxyethyl diethylene triamine
Tetraethylene pentamine
Guanidine hydrochloride
Piperidine
Pyrrolidine
2,5-dimethyl piperazine
Polyethylene imine
p-Aminophenol
2,4-diaminophenol dihydrochloride
Meta-amino-benzoic acid
Hydrazine
Methyl hydrazine
Symmetrical dimethylhydrazine
Unsymmetrical dimethylhydrazine
Hydroxylamine hydrochloride
N,N-diethyl hydroxylamine
Ethyl hydroxylamine
Methyl benzyl hydroxylamine
O-methyl hydroxylamine
β-hydroxyethyl trimethyl ammonium hydroxide In some cases the organic development activator can provide silver halide developing activity.

A useful photographic process according to the invention can comprise the steps of exposing a photographic element comprising photographic silver halide to form a latent image in the photographic element; developing the latent image with a processing composition at a pH of about 12 to about 14 comprising a hydroxylamine silver halide developing agent; contacting undeveloped silver salts in the photographic element with a silver halide complexing agent which is 1,3-dithiane-1,1,3,3-tetraoxide; 1,3-dithia-cycloheptane-1,1,3,3-tetraoxide; 1-methyl-3,3-dioxo-1,3-dithionium perchlorate and methyl-2,2,2-trifluoroethyl sulfone to form an image wise distribution of a silver complex in the unexposed areas of the photographic silver salt, transferring at least part of the silver complex to an image receiver layer contiguous to the photographic silver salt; reducing the silver complex in the presence of development nuclei to form a visible image on the receiver layer; and lowering the pH of the receiver layer to below about 8 to provide a stable developed image.

Processing conditions, time of development and the like can vary depending on several factors, such as the desired image, the particular organic silver halide complexing agent, the particular silver halide developing agent, image receiver and the like. Typically, processing is carried out under ambient conditions and is completed within about 60 seconds such as within about 10 seconds. Processing temperatures are typically about 20° C. to about 30° C., but elevated temperatures can be employed, if desired, such as temperatures up to about 50° C.

The described photographic element, receiving element and/or processing composition can also contain toning agents. Typical toning agents which can be employed include, for example, polyvalent inorganic salts as described in U.S. Pat. No. 2,698,236 of Land issued Dec. 28, 1954; silica as described in U.S. Pat. No. 2,698,237 of Land issued Dec. 28, 1954; and heterocyclic mercaptans such as mercaptoazoles, e.g. mercaptodiazoles, mercaptotriazoles, mercaptotetrazoles, and the corresponding selenazoles. Toning agents are typically employed at concentrations which are much less than concentrations which would provide silver halide solvent activity in a diffusion transfer system.

The photographic elements, processing compositions, and/or image receivers employed in the practice of the invention can contain antioxidants, such as aldehyde-bisulfite common condensation products, e.g., sodium formaldehyde bisulfite.

Also, the image receiver can contain an acid or acid releasing compound, especially polymeric acid, which can provide lower pH in the image receiver after desired processing.

The concentrations of developing agents used in the practice of the invention can vary over wide ranges depending on the particular photographic system, particular developing agents, particular silver halide complexing agents, processing conditions and the like. Typically, when a developing agent is employed in a photographic element, as described, it is important that a concentration of about 0.01 to about 5 moles of developing agent per mole of silver be present in the photographic element. When a developing agent, as described, is employed in a processing composition, the total concentration of developing agent in the composition is typically about 0.01 percent to about 10 percent, preferably about 1 percent to about 5 percent by weight of the total processing composition.

A processing composition can be prepared by mixing the following components:

| | |
|---|---|
| Water | 100 ml. |
| Sodium hydroxide | 7.5 grams |
| Sodium sulfite, desiccated | 6.4 grams |
| Hydroquinone | 1.1 grams |
| N—methyl-p-aminophenol sulfate | 0.015 grams |
| Aminoethyl ethanolamine | 2.3 ml. |

The processing composition has a pH of at least 12 at 20° C. A photographic element is prepared by coating a gelatino, fine-grain silver bromoiodide photographic emulsion on a poly(ethylene terephthalate) film support. The resulting photographic silver halide film is exposed sensitometrically to a conventional step wedge and then immersed quickly the described processing composition. The film is then laminated to a nucleated image receiver. The image receiver is prepared by coating a polyethylene coated paper support with palladium development nuclei dispersed in a polymeric binder. The photographic film is pressed together with the image receiver for 10 seconds. After this time the so-called sandwich is peeled apart and the resulting image on the image receiver is observed.

Employing this procedure with 9 grams of 1,3-dithiane-1,1,3,3-tetraoxide added to the processing composition, as described, per 100 ml. of the processing composition, provides a developed image on the receiver having a maximum reflection density of 0.72 and a minimum reflection density of 0.10.

The following examples are included for a further understanding of the invention.

EXAMPLE 1

To 2 ml of a turbid 0.001 M AgBr suspension in 0.001 M KBr, about $10^{-4}$ moles of the test compound was added after it had been dissolved in either a borax buffer (pH 9.1) or in 0.1 to 5 M NaOH (pH above 12). About one minute after mixing, the dispersion was examined for its optical clarity. Results are listed below:

| Compound Structure | Borax | NaOH |
|---|---|---|
| $H_2O$ (or 50% $CH_3OH$) Control | turbid | turbid |
| $(CH_3—CO—)_2CH_2$ | " | clear |
| $NCCH_2CONH_2$ | " | " |
| $(H_2NCO)_2CH_2$ | " | " |
| n = 3, n = 4 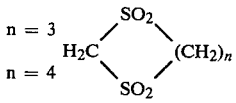 | " | " |
| $CH_3SO_2CH_2CN$ | " | " |
| $CH_3SO_2CH_2S(CH_3)_2\ ClO_4^{\ominus}$ | " | " |
| $H_2C(PPh_2CH_2CH_2OH)_2\ 2BF_4^{\ominus}$ | " | " |

It can be concluded from these examples that none of the cited compounds are useful AgBr solvents at pH 9.1 but that they do dissolve AgBr at higher $OH^-$ concentrations.

EXAMPLE 2

This example cites rates of clearing a coarse silver bromoiodide gelatin coating when immersed in an alkaline solution of the test compound. These rates were measured immediately after preparation of the alkaline test solutions and they are expressed relative to those obtained with $Na_2S_2O_3$ under the indicated conditions. Thus, a relative rate of 0.25 indicates that clearing was 4 times slower than with hypo whereas a relative rate of 3 indicates a 3-fold clearing time than was obtained with hypo.

| Test Compound Structure | Relative Clearing Rates, ±10% 0.5M NaOH and 0.16M Test Cpd. | 0.1M NaOH and 0.02M Test Cpd. |
|---|---|---|
| $Na_2S_2O_3$ | 1 | 1 |
| Uracil (a) | 0.078 | |
| 4,5-imadazoledicarboxylic acid (b) | 0.05 | |
| $H_2C(SO_2C_2H_5)_2$ (c) | 0.52 | |
| $H_2C(SO_2CH_2CH_2OH)_2$ (c) | 0.22 | |
| n = 3 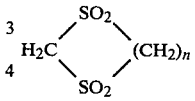 | | 3.4 |
| n = 4 | | 1.8 |
| $CH_2(CN)_2$ | 0.026 (d) | |
| $CH_3SO_2CH_2CN$ | 0.58 (d) | |
| $CH_3SO_2CH_2\overset{\oplus}{S}(CH_3)_2\ ClO_4^{\ominus}$ | 0.25 | |

(a) A compound of U.S. Pat. No. 2,857,274
(b) A compound of U.S. Pat. Application Ser. No. 195,463, now abandoned
(c) A compound of U.S. Pat. No. 3,625,699
(d) No clearing activity observed 24 hrs. after preparation of test solution.

Except for hypo, none of the indicated compounds cleared and fixed the emulsion at pH 8. It is concluded from this example that the NC-activated carbon acids in alkali exhibit a time-dependence for their reaction with silver halide because of the hydrolysis of the —C≡N group which then makes the compound inert as silver halide solvent. Moreover, these compounds not only fix conventional emulsions but they may do so as at rates substantially faster than obtainable with previously accessible silver halide solvents.

EXAMPLE 3

The carbon acid silver halide solvents of our invention were evaulated in a silver diffusion transfer viscous developer containing potassium hydroxide and diethylhydroxylamine having a pH of at least 12 at 20° C.

The photographic element was prepared by coating a gelatino, fine-grain silver bromoiodide photographic emulsion on a poly(ethylene terephthalate) film support. The resulting photographic silver halide film was exposed sensitometrically to a conventional step wedge and then immersed quickly in the processing composition. The film is then laminated to a nucleated image receiver. The image receiver was prepared by coating a polyethylene coated paper support with nickel/sulfide-silver iodide development nuclei. The photographic film was pressed together with the image receiver for 30 seconds. After this time the so-called sandwich was peeled apart and the resulting image on the image receiver was observed by measuring the difference between the maximum and minimum density (ΔD).

| Compound (.175M) | Dmax | ΔD |
|---|---|---|
| 1,3-Dithiane-1,1,3,3-tetra-oxide | 0.54 | 0.46 |
| 1,3-Dithiacycloheptane-1,1,3,3-tetraoxide | 1.37 | 1.26 |
| Dimethyl(methylsulfonyl-methyl)sulfonium perchlorate | 0.45 | 0.10 |
| Malononitrile | 0.17 | 0.08 |
| None (Control) | 0.08 | 0.00 |

EXAMPLE 4

A coarse grain silver bromoidiode emulsion coated at 50 mg/dm$^2$ on a film support was immersed in a 0.2 molar alkaline solution of sodium hydroxide (pH 13.3). To the immersed silver bromoiodide emulsion was added a solubilizing agent as described in the following table. The time to clear the emulsion was recorded.

| Compound No. | Compound | Molar Amt. | Clearing Rate (Sec.) |
|---|---|---|---|
| 1 | $Na_2S_2O_3$ (without alkali) | .01 | 86 |
| 2 | $(CH_3SO_2)_2CH_2$ | .003 | 55 |
| 3 | $CH_3SO_2CH_2\overset{\oplus}{S}(CH_3)_2$ pts.$^{\ominus}$ | .003 | 36 |
| 4 | 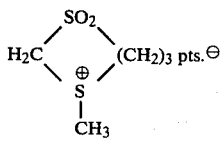 | .003 | 22 |
| 5 | 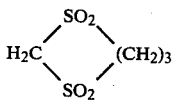 | .003 | 30 |

It was observed that compounds of the prior art, Compounds 1 and 2, require substantially more time to clear the emulsion than do the compounds of the invention, Compounds 3–5. Moreover, compared to Compound 2, ionic compounds such as No. 3 and No. 4 exhibited advantageously high water solubilities.

EXAMPLE 5

The silver halide solvents described in Example 4 were tested in a photographic material as follows.

A silver bromoiodide emulsion was prepared and separated into equal portions. To each portion was added a silver halide solvent as described in the following table. The emulsion samples were then coated at pH 6.0 on a film support at 50 mg/dm$^2$, exposed, developed for 5 minutes in Kodak Developer DK-50[1], fixed, washed and dried. The following results were observed.

| Compound No. (mg/Ag mole) | Relative Speed | γ | Dmin |
|---|---|---|---|
| Control | 100 | 1.27 | .21 |
| 1 (1.5) | 74 | 1.15 | .28 |
| 1 (4.5) | 68 | 0.95 | .48 |
| 1 (15.0) | 42 | 0.77 | .89 |
| 2 (1.5) | 80 | 1.25 | .18 |
| 2 (4.5) | 80 | 1.27 | .18 |
| 2 (15.0) | 80 | 1.27 | .20 |
| 3 (1.5) | 87 | 1.15 | .32 |
| 3 (4.5) | 95 | 1.27 | .22 |
| 3 (15.0) | 100 | 1.25 | .20 |
| 4 (1.5) | 91 | 2.80 | .20 |
| 4 (15.0) | 100 | 1.25 | .21 |
| 5 (1.5) | 95 | 1.20 | .21 |
| 5 (4.5) | 95 | 1.10 | .24 |
| 5 (15.0) | 68 | 0.77 | .82 |

It was clearly observed from the above table that compared with silver halide solvents of the prior art, the compounds of the invention were relatively inert when added to a photographic element prepared under normal pH conditions.

EXAMPLE 6

To separate portions of a large grain polydispersed silver bromoiodide emulsion were added the silver halide solvents at the levels described in the following table. The emulsion samples were then coated on a film support at 8.6 mg of silver/dm$^2$ and immersed in a 1.0 mole sodium hydroxide solution (pH 14.0). The following results were observed:

| Example Number | Compound (mg/dm$^2$) | Clearing Rate |
|---|---|---|
| 1 | Control | did not clear |
| 2 | A (12) | 5 minutes |
| 3 | B (12) | 2 minutes |

Compound A — Uracil
Compound B — Dimethyl-methylsulfonylsulfonium pts.

The above table shows that prior art compound A fixes silver halide emulsions at a slower rate when compared to the compounds of the invention.

[1]Kodak Developer DK-50 has the following formula:

| KODAK DEVELOPER DK-50 | |
|---|---|
| Water, about 50C. | 500 cc |
| Elon Developing Agent | 2.5 grams |
| Sodium Sulfite, desiccated | 30.0 grams |
| Hydroquinone | 2.5 grams |
| Balanced Alkali | 10.0 grams |

-continued

[1]Kodak Developer DK-50 has the following formula:

KODAK DEVELOPER DK-50

| | |
|---|---|
| Potassium Bromide | 0.5 gram |
| Water to make | 1.0 liter |

The invention has been described in detail with particular reference to preferred embodiments thereof, but it will be understood that variations and modifications can be effected within the spirit and scope of the invention.

We claim:

1. In a photographic silver salt, chemical transfer product comprising (a) a photographic element comprising photographic silver halide, (b) a processing composition, and (c) an image receiving layer comprising development nuclei, said product comprising an organic silver halide complexing agent, the improvement wherein said silver halide complexing agent is a carbon acid of the formula:

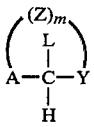

wherein

CH is a carbon acid moiety with a pKa greater than about 8 and less than about 16, m is 0 or an integer of 1 through 4, Z taken with A and Y represents atoms completing a 4 to 7-member heterocyclic nucleus, and (1) when m is 1 through 4, A and Y each independently represents $$-SO_2-;\ X^-(R)_2\underset{|}{N}^+-;\ X^-R-\underset{|}{S}^+-;\ X^-(R)_2P^+-;\ -\underset{\underset{O}{\|}}{C}-$$

where R is alkyl containing 1–7 carbon atoms, with the proviso that A and Y are not both $-SO_2-$, L is H, alkyl containing 1 to 7 carbon atoms or aryl containing 4–12 carbon atoms, $X^-$ is an anion;

(2) when m is zero as in the formula:

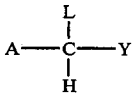

A and Y are independently:

| A | Y |
|---|---|
| $RSO_2-$ | $-NO_2$ |
| NC— | —CN |
| $F_3C-$ | $-CF_3$ |
| $X^-(R)_3P^+-$ or | $-N(R)_3X^-$ or |
| $X^-(R)_2S^+-$ or | $-S^+(R)_2X^-$ or |
| $X^-(R)_3N-$ or | $-P^+(R)_3X^-$ or |
| $R^1\underset{\underset{O}{\|}}{C}-$ | $-\underset{\underset{O}{\|}}{CR^1}$ |

where $R^1$ is R, OR, $NH_2$ or $NR_2$, R is alkyl containing 1 through 7 carbon atoms with the proviso that Y is not —CN when A is $RSO_2-$ and wherein L is as defined above.

2. A photographic silver salt chemical transfer product of claim 1 in which said formula is

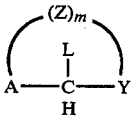

wherein

CH is a carbon acid moiety with a pKa greater than about 8 and smaller than about 16, A is $-SO_2-$, $$Y \text{ is } -\overset{\oplus}{\underset{\underset{CH_3}{|}}{S}}-\overset{\ominus}{X},$$

Z represents $(CH_2)$, m is a whole integer of 1 through 4,

L represents hydrogen or alkyl containing 1–7 carbon atoms, $X^\ominus$ is an anion.

3. The photographic silver salt, chemical transfer product of claim 1 wherein said processing composition comprises a hydroxylamine silver halide developing agent.

4. The photographic product of claim 1 wherein said organic, silver halide complexing agent is the sole silver halide complexing agent.

5. In a photographic silver salt, chemical transfer product of claim 1 comprising (a) a photographic element comprising photographic silver halide, (b) a processing composition, and (c) an image receiving layer comprising development nuclei, said product comprising an organic, carbon acid silver halide complexing agent, the improvement wherein said silver halide complexing agent is a sulfone or a nitrile.

6. The photographic silver salt, chemical transfer product of claim 5 wherein said organic, silver halide complexing agent is dimethyl(methylsulfonylmethyl)-sulfonium perchlorate.

7. The photographic silver salt, chemical transfer product of claim 5 wherein said organic, silver halide complexing agent is malononitrile.

8. The photographic silver salt, chemical transfer product of claim 5 wherein said organic, silver halide complexing agent is 1-methyl-3,3-dioxo-1,3-dithionium p-toluene sulfonate.

* * * * *